US007559623B2

(12) United States Patent
Tamaki et al.

(10) Patent No.: US 7,559,623 B2
(45) Date of Patent: Jul. 14, 2009

(54) IMAGE RECORDING APPARATUS

(75) Inventors: Shuichi Tamaki, Nagoya (JP); Toshio Sugiura, Anjo (JP); Kenji Samoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 391 days.

(21) Appl. No.: 11/616,422

(22) Filed: Dec. 27, 2006

(65) Prior Publication Data

US 2007/0146408 A1 Jun. 28, 2007

(30) Foreign Application Priority Data

Dec. 28, 2005 (JP) ..... 2005-380140

(51) Int. Cl.
*B41J 23/00* (2006.01)

(52) U.S. Cl. ..... 347/37; 347/19

(58) Field of Classification Search ..... 347/19, 347/14, 37

See application file for complete search history.

(56) References Cited

U.S. PATENT DOCUMENTS 6,042,281 A * 3/2000 Ohtani ..... 400/279
6,193,350 B1 * 2/2001 Hadley ..... 347/19
7,387,360 B2 * 6/2008 Ohashi ..... 347/37

FOREIGN PATENT DOCUMENTS

JP 2004160871 A 6/2004

* cited by examiner

*Primary Examiner*—Lamson D Nguyen
(74) *Attorney, Agent, or Firm*—Baker Botts L.L.P.

(57) ABSTRACT

An image recording apparatus according to the present invention comprises a linear encoder which includes a linear scale and a support section which supports one end of the linear scale, the support section including: a support member which has a holding portion that holds said one end of the linear scale and which is movable such that the holding portion moves along a predetermined path; and an elastic member which biases the support member in a direction in which tension is given to the linear scale.

19 Claims, 8 Drawing Sheets

IMAGE RECORDING APPARATUS

The present application is based on Japanese Patent Application No. 2005-380140 filed on Dec. 28, 2005, the contents of which are incorporated herein by reference.

BACKGROUND OF THE INVENTION

1. Field of the Invention

The present invention relates to an image recording apparatus comprising a linear encoder.

2. Discussion of Related Art

There has conventionally been known an image recording apparatus, such as an ink-jet printer, which forms an image on a recording medium such as a recording sheet and which has a structure to record the image on the recording medium by alternately moving a carriage on which a recording head is mounted in a main scanning direction and the recording medium in a sub scanning direction. In addition, there has generally been known that the above-described image recording apparatus is equipped with a linear encoder so as to detect a position of the carriage in the main scanning direction. More specifically, the linear encoder comprises a belt-like linear scale which has a plurality of detectable portions (such as marks or slits) arranged at a predetermined pitch and which is provided along the main scanning direction. The linear encoder also comprises a detector, mounted on the carriage, which detects each of the detectable portions (strictly speaking, a part of said plurality of the detectable portions at a time) so as to detect a position of the carriage, namely, to detect a position of the recording head mounted on the carriage.

In the thus constructed image recording apparatus, the linear scale is provided along the main scanning direction such that both end portions of the linear scale are supported. However, the detection accuracy of the position of the carriage lowers as the linear scale is slackened by gravity.

Therefore, as being disclosed in JP-A-2004-160871 for instance, there has been proposed an image recording apparatus which comprises a plate spring (i.e., a leaf spring or a flat spring) that supports one end of the linear scale. In the image recording apparatus, the plate spring is fixed on one of left and right side plates of a box-like main body chassis. One end of the linear scale is supported by the plate spring and the other end thereof is supported by the other side plate of the main chassis. Owing to the arrangement, the linear scale, provided along the main scanning direction, is appropriately tensioned so as to prevent the slackness of the linear scale.

SUMMARY OF THE INVENTION

However, in the image recording apparatus disclosed by the above-indicated patent document, it is difficult to support the linear scale in an appropriately tensioned state because the plate spring as an elastic member directly supports one end of the linear scale. Further, there is a risk that a hand of an operator accidentally touches the linear scale at maintenance, assembly work or the like. In the situation, it is preferred that one end of the linear scale be supported so as to be movable toward the other end over a comparatively long distance. In the image recording apparatus comprising the structure in which the plate spring directly supports one end of the linear scale, it is difficult to secure an adequate distance for said one end of the linear scale to move in the tensioned state, thus rendering it difficult for the image recording apparatus to deal with the above-indicated situation.

The above-indicated problem is one of numerous problems of the conventional image recording apparatus equipped with the linear encoder. An image recording apparatus of the kind has various problems, and coping with any one of said various problems enables the image recording apparatus to improve the utility thereof. That is, the utility of the conventional image recording apparatus can be largely improved with respect to many aspects. In this background, the present invention has been developed with an object of offering a highly practical image recording apparatus.

In order to achieve the above-indicated object, the present invention has been developed. An image recording apparatus according to the present invention comprises a linear encoder which includes a linear scale and a support section which supports one end of the linear scale, the support section including: a support member which has a holding portion that holds said one end of the linear scale and which is movable such that the holding portion moves along a predetermined path; and an elastic member which biases the support member in a direction in which tension is given to the linear scale.

In the present image recording apparatus including the above-indicated structure, the linear scale can be supported more appropriately in the tensioned state, as compared with the structure in which an elastic member, such as a plate spring, directly supports the linear scale. In addition, depending upon the structure of the support section, it is possible to permit said one end of the linear scale to move toward the other end over a comparatively long distance in the tensioned state.

BRIEF DESCRIPTION OF THE DRAWINGS

The above and optional objects, features, and advantages of the present invention will be better understood by reading the following detailed description of preferred embodiments of the invention when considered in conjunction with the accompanying drawings, in which.

DETAILED DESCRIPTION OF THE PREFERRED EMBODIMENT

Figure 1:
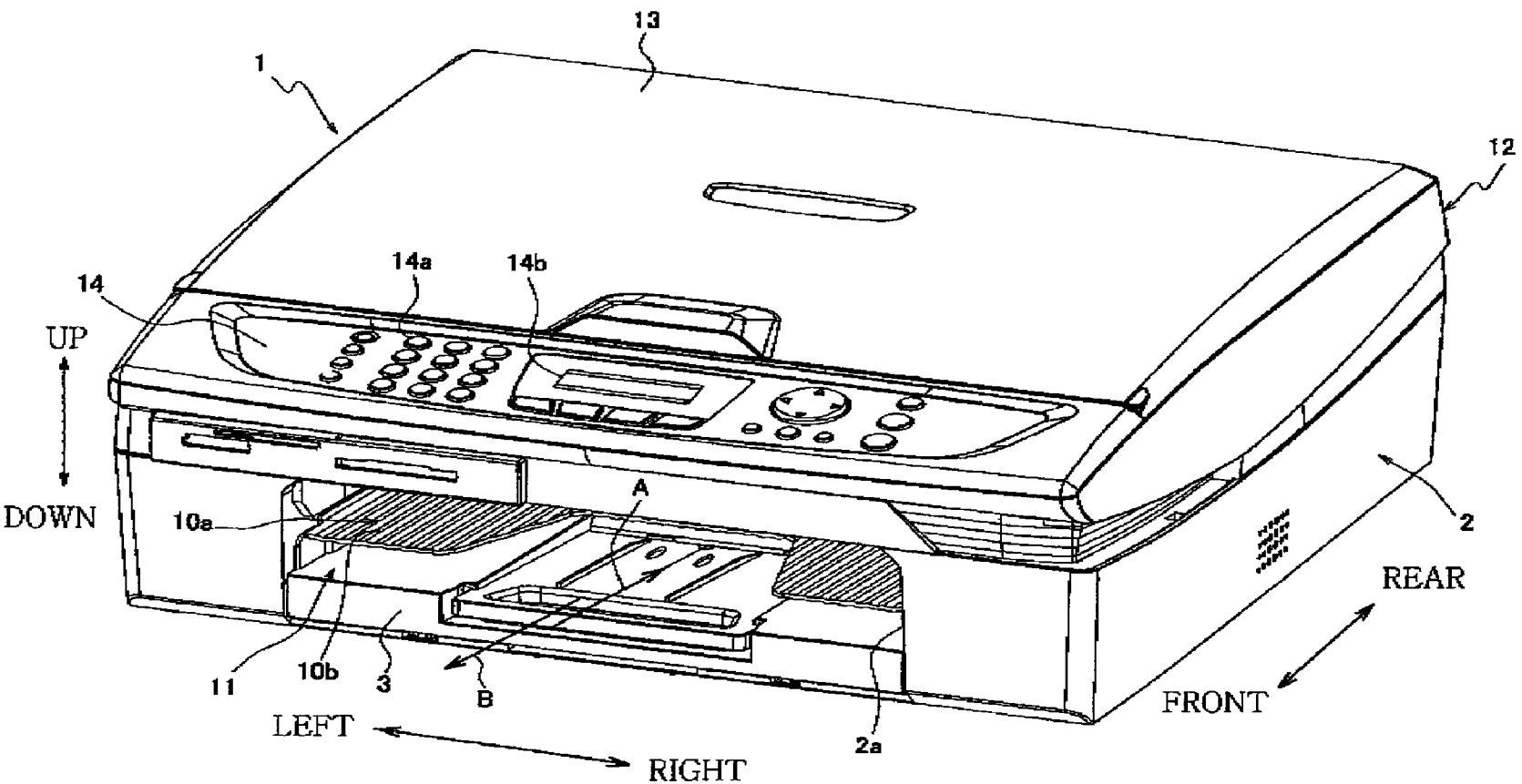
FIG. 1 is a perspective view of an appearance of a multiple-function device (MFD) to which the present invention is applied.
Figure 2:
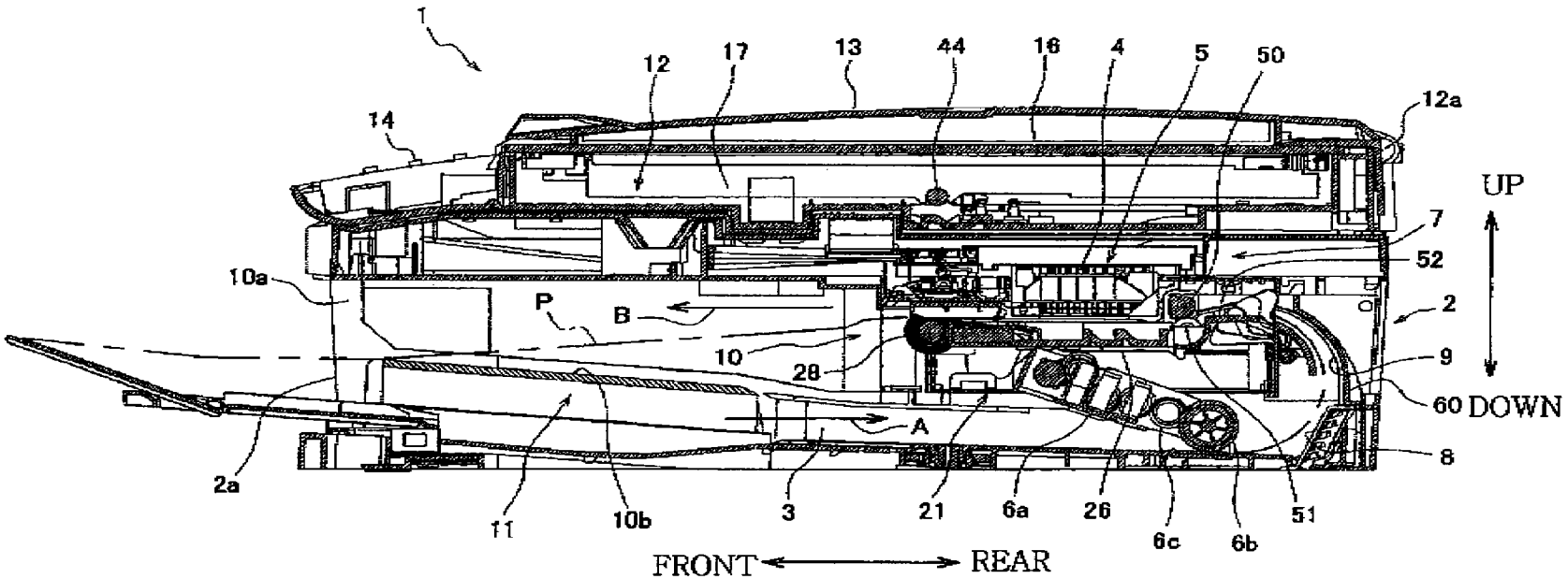
FIG. 2 is a cross-sectional view of the MFD.

Hereinafter, there will be described a preferred embodiment of the present invention by reference to the drawings. FIG. 1 is a perspective view of the appearance of the multiple-function device (MFD) 1 as the image recording apparatus of the present invention, and FIG. 2 is the cross-sectional view of the MFD 1. In the following description, an upward and a downward direction are defined in a normal usage status of the MFD 1, as shown in FIG. 1, a frontward and a rearward direction are defined such that a side on which an operation panel 14 (described later) is provided is defined as a front side, and a rightward and a leftward direction are defined by a person facing the MFD 1.

The MFD 1 has a printing function, a scanning function, a color-image copying function and a facsimile function. As shown in FIGS. 1 and 2, an image reading device 12 which is used for reading an original text, i.e., an original image, is disposed in a upper portion of a housing 2 which is formed by injection-molding of a synthetic resin.

The image reading device 12 is arranged to be pivotable upwards and downwards about a left-hand end of the housing 2 via a shaft (not shown). Also, a cover 13 covering an upper surface of the image reading device 12 is pivotally attached at its rear end to a rear end of the image reading device 12 through a shaft 12*a* (shown in FIG. 2) so that the cover 13 is pivotable upwards and downwards about the shaft 12*a*.

As shown in FIG. 2, in a upper portion of the image reading device 12, there is provided a glass plate 16 on which an original text is to be placed when the cover 13 is opened upwards. Below the glass plate 16, an image scanning device (CIS: Contact Image Sensor) 17 for reading an image on the text is provided so as to be capable of reciprocating along a guide rod 44 which extends in a direction perpendicular to a sheet plane of FIG. 2 (i.e., a main scanning direction or a rightward and a leftward direction).

Further, as shown in FIGS. 1 and 2, on a front side of the image reading device 12, there is provided an operation panel 14 having operation keys 14*a* to input operator's instructions and a liquid crystal display (LCD) 14*b* to display various kinds of information.

Meanwhile, on a lower or bottom portion of the housing 2, there is disposed a sheet-supply portion 11 which supplies a recording sheet P as recording medium. In the sheet-supply portion 11, there is disposed a sheet-supply cassette 3 accommodating a stack of recording sheets P such that the sheet-supply cassette 3 can be attached into or detached from the housing 2 in the rearward or a frontward direction through a front opening 2*a* which is formed in the front face of the housing 2. In the present embodiment, the sheet-supply cassette 3 is arranged to accommodate a stack of recording sheets P of a selected size such as an A4 size, a letter size, a legal size or a postal-card size, such that the width of each sheet P extends in a direction (i.e., the main scanning direction or the rightward and a leftward directions) which is perpendicular to a sheet-supply direction (i.e., a sub scanning direction, the rearward and frontward directions, or a direction indicated by an arrow A).

As shown in FIG. 2, adjacent to the rear end of the sheet-supply cassette 3, there is disposed an inclined sheet-separate plate 8 for separating one recording sheet P from the stack of recording sheets P. The inclined sheet-separate plate 8 has a convexly curved shape in its plan view in which a lengthwise central portion thereof corresponding to widthwise central portions of the sheets P protrudes from lengthwise opposite end portions of the plate 8 toward the leading edges of the sheets P. The central portion of the sheet-separate plate 8 is provided with a serrate elastic separator pad to promote separation of each sheet P by engaging the leading edge of each sheet P.

Also in the sheet-supply portion 11, a sheet-supply arm 6*a* is supported, at a proximal end thereof, by the housing 2 such that the sheet-supply arm 6*a* is pivotable upwards and downwards A rotary drive force from a conveying motor (not shown) is transmitted to a sheet-supply roller 6*b* attached to a distal end of the sheet-supply arm 6*a* by a gear transmission mechanism 6*c* disposed in the sheet-supply arm 6*a*. The sheet-supply roller 6*b* and the elastic separator pad of the inclined sheet-separate plate 8 cooperate with each other to separate an uppermost sheet P from the stack of recording sheets P accommodated in the sheet-supply cassette 3, and then convey the separated sheet P in a sheet-supply direction (i.e., the direction indicated by arrow A) toward an image recording portion 7 located above the sheet-supply cassette 3, via a sheet-supply path 9 including a U-turn portion having a substantially U-shaped cross section between a first path section 60 and a second path section 52.

Figure 3:
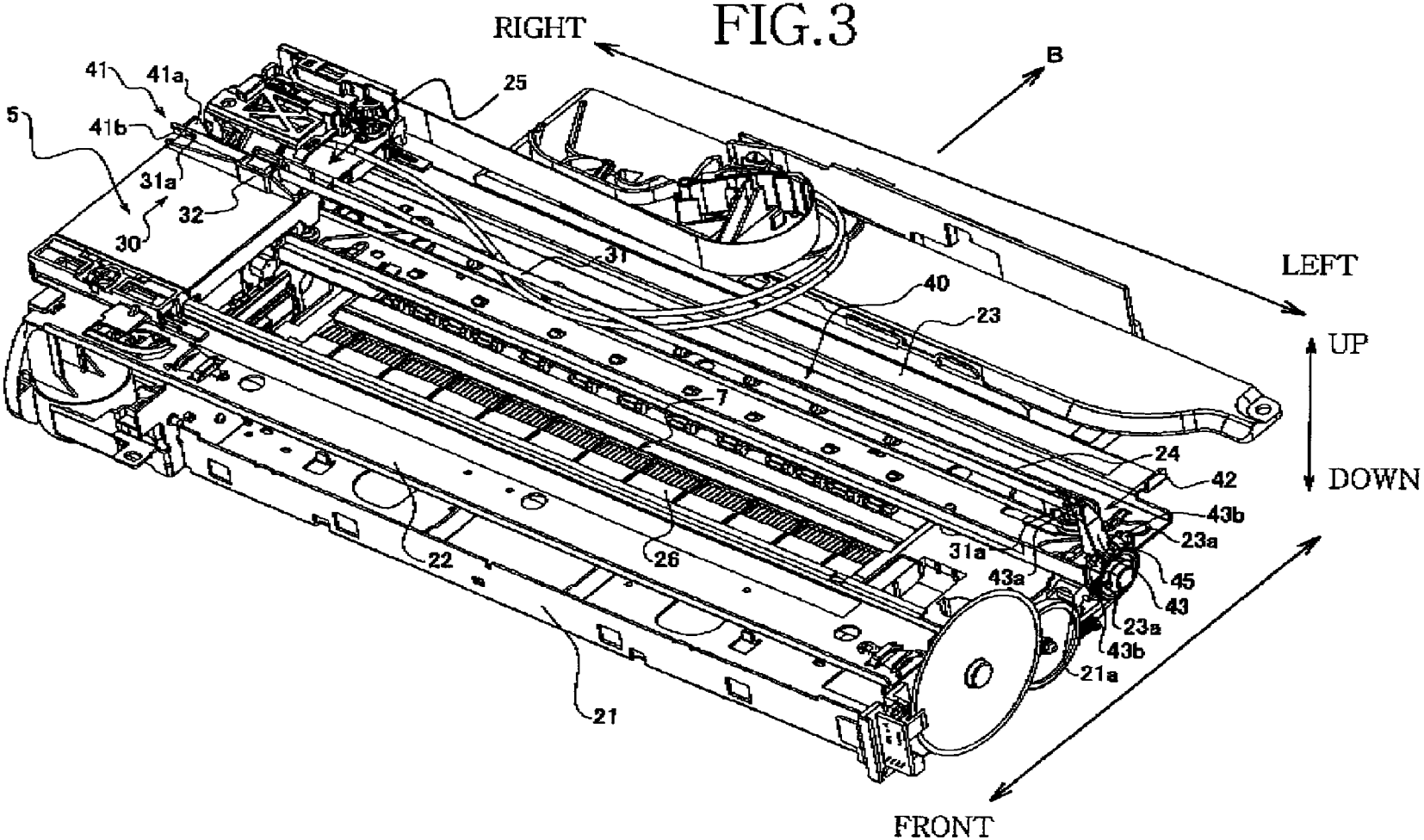
FIG. 3 is a perspective view of an image recording portion of the MFD.

FIG. 3 is a perspective view of the image recording portion 7 of the MFD 1. As shown in FIG. 3, the image recording portion 7 is disposed in a space between a main frame 21 having an upward-opening box-like shape and two guide members, i.e., a first guide member 22 and a second guide member 23. The first guide member 22 and the second guide member 23 are supported by a pair of left-hand and right-hand side walls 21*a*, 21*b* (not shown) of the main frame 21, and each of the guide members 22, 23 has an oblong plate-like configuration which extends in the main scanning direction. The image recording portion 7 comprises an ink-jet recording head 4 (shown in FIG. 2) which records an image on a recording sheet P by ejecting ink droplets from a bottom surface thereof and a carriage 5 on which the recording head 4 is mounted.

The carriage 5 is mounted on the first guide member 22 located on an upstream side thereof with respect to a sheet-discharge direction (i.e., a direction indicated by an arrow B) and the second guide member 23 located on a downstream side of the carriage 5 with respect to the sheet-discharge direction, such that the carriage 5 bridges these two guide members 22 and 23, and such that the carriage 5 is capable of sliding on the guide members 22 and 23. Namely, the carriage 5 is capable of reciprocating in the rightward and leftward directions. On the upper surface of the second guide member 23 disposed on the downstream side of the carriage 5 in the sheet-discharge direction, a timing belt 24 which extends in the main scanning direction is disposed to reciprocate the carriage 5. On a lower surface of the second guide member 23, there is fixed a CR (carriage) motor (not shown) which drives the timing belt 24. The carriage 5, the timing belt 24 and the CR motor (not shown) constitute a head-moving device 25.

Meanwhile, in tile image recording portion 7, a platen 26 having a flat shape is fixedly provided on the main frame 21 and interposed between the first and second guide members 22, 23. Further explained, the platen 26 extends in the rightward and leftward directions so as to face the bottom surface of the recording head 4 mounted on the carriage 5 and support a reverse surface of the recording sheet P.

As shown in FIG. 2, on an upstream side of the platen 26 as viewed in the sheet-discharge direction (i.e., the direction indicated by arrow B), there are disposed a drive roller 50 and a nip roller 51, as a pair of feeding rollers (registering rollers) for feeding the sheet P to an upper surface of the platen 26 (or the bottom surface of the recording head 4). The nip roller 51 is disposed below the drive roller 50 so as to face the same 50. On a downstream side of the platen 26 as viewed in the sheet-discharge direction, there are disposed a sheet-discharge roller 28 and a spur roller (not shown). The sheet-discharge roller 28 is driven to feed the recording sheet P which has passed through the image recording portion 7 in the sheet-discharge direction to a sheet-discharge portion 10, and the spur roller (not shown) faces the sheet-discharge roller 28 and is biased toward the same 28.

The recording sheet P on which the image has been recorded by the image recording portion 7 is discharged to the sheet-discharge portion 10, with the image-recorded surface of the recording sheet P facing upwards. The sheet-discharge portion 10 is located above the sheet-supply portion 11, and a front opening 10*a* communicating with the sheet-discharge portion 10 opens in the front surface of the housing 2 so as to be continuous with the front opening 2*a* of the housing 2. The recording sheets P discharged from the sheet-discharge portion 10 in the sheet-discharge direction are piled on a sheet-discharge tray 10*b* disposed inside the front opening 10*a*.

An ink storage portion (not shown) is disposed at a right-hand corner of the front portion of the housing 2 that is covered by the image reading device 12. In the ink storage portion, there are attached four ink cartridges storing mutually different four color inks, i.e., black ink (BK), cyan ink (C), magenta ink (M) and yellow ink (Y). Each of tie four ink cartridges can be attached or detached in a state in which the image reading device 12 is opened upwards. Each of the ink cartridges is connected to the recording head 4 via a flexible ink-supply tube. Accordingly, each of the four inks contained in a corresponding one of the four ink cartridges is supplied to the recording head 4 via a corresponding one of the four ink-supply tubes.

As shown in FIG. 3, the MFD 1 is equipped with a linear encoder 30 for detecting a position of the carriage 5, more specifically described, a position of the recording head 4 mounted on the carriage 5. The linear encoder 30 comprises a linear scale 31 and a detector 32.

The linear scale 31 is an elongated-belt-shaped and resin-made film. The linear scale 31 has a plurality of detectable portions (not shown) arranged at a predetermined pitch in a longitudinal direction thereof The linear scale 31 is disposed at a position above the carriage 5 such that opposite ends of the linear scale 31 horizontally extend along the main scanning direction. A linear scale support device that supports the opposite ends of the linear scale 31 will be described later.

The detector 32 is mounted on an upper portion of the carriage 5 so as to detect the detectable portions of the linear scale 31 without touching the detectable portions. More specifically, the detector 32 has a photo-interrupter comprising a light emitting element and a light receiving element which face each other. The linear scale 31 is interposed between the light emitting element and the light receiving element, whereby the photo-interrupter detects the detectable portions of the linear scale 31. In the MFD 1, the detector 32 detects the detectable portions of the linear scale 31 as the carriage 5 reciprocates in the main scanning direction, whereby a position of the carriage 5 is detected in the main scanning direction.

Figure 4A:
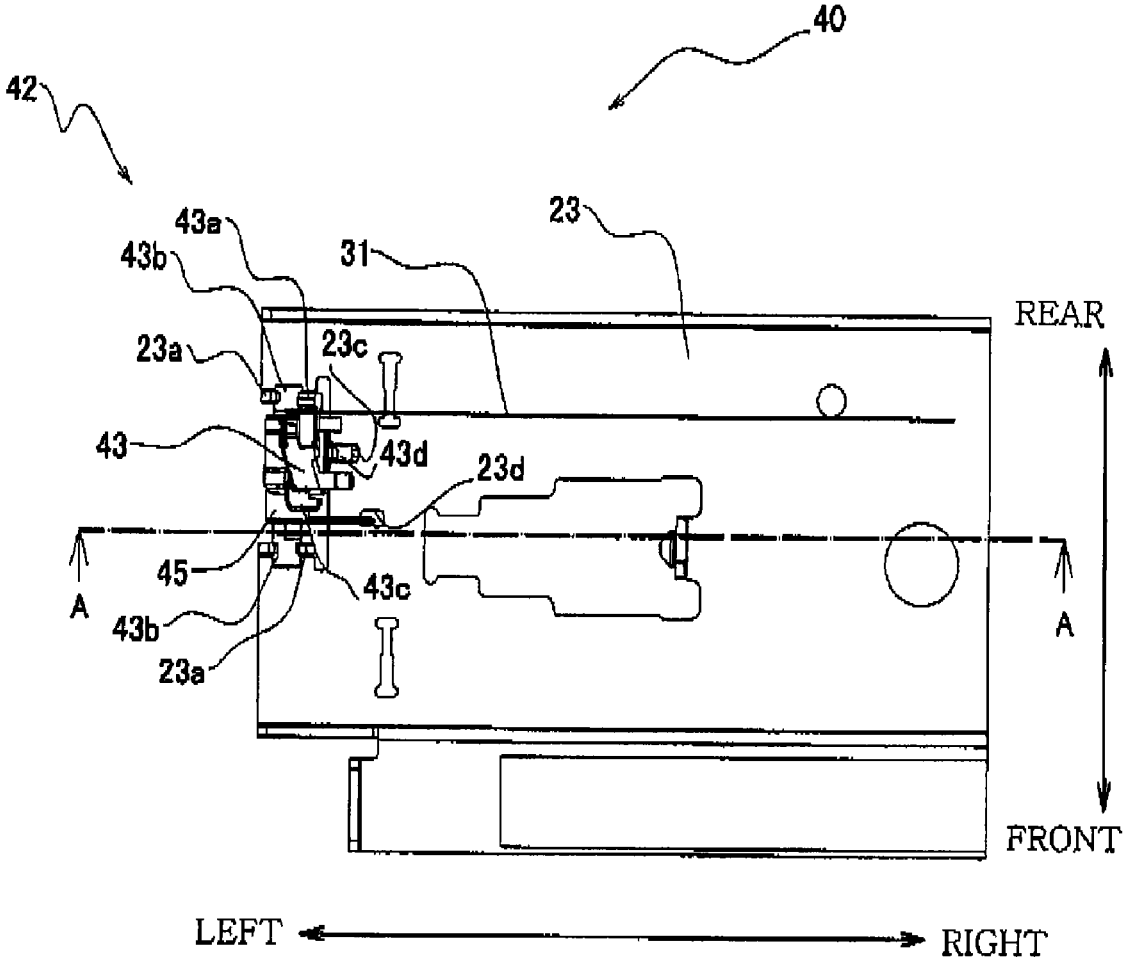
FIG. 4A is an enlarged top view of left-side end of an encoder support portion.
Figure 4B:
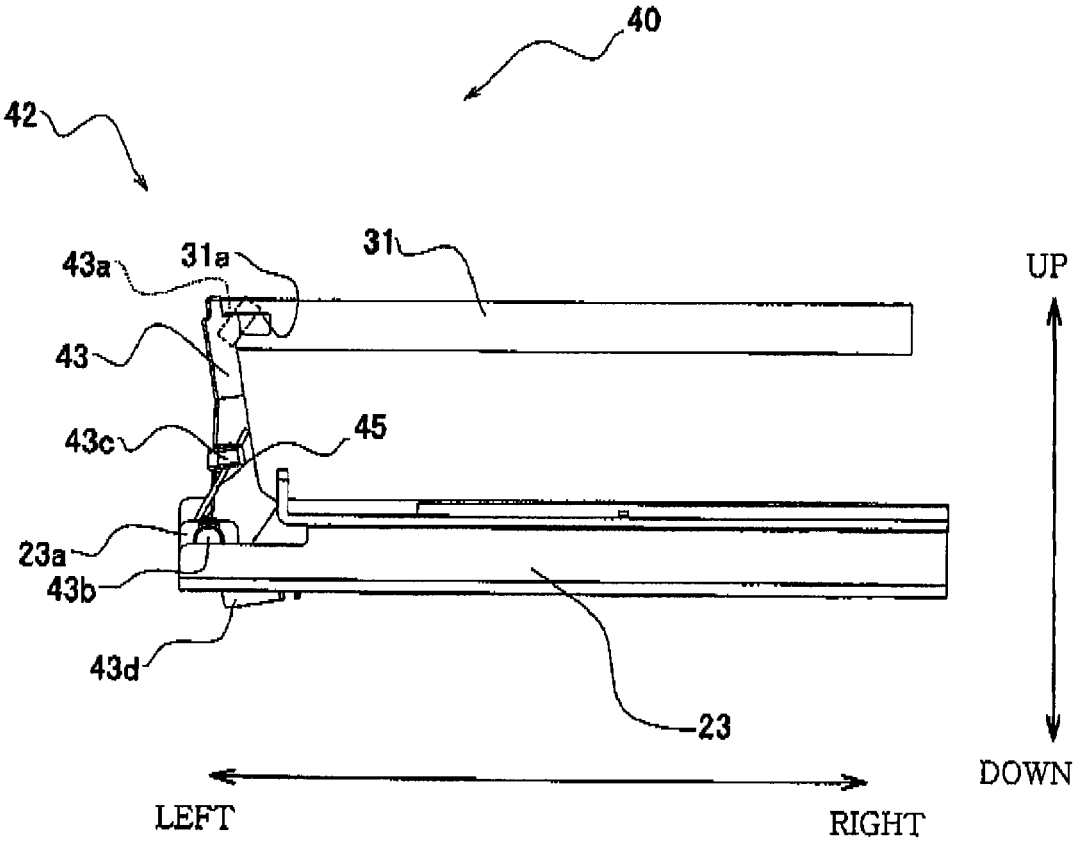
FIG. 4B is an enlarged front view of the left-side end of an encoder support portion.
Figure 5:
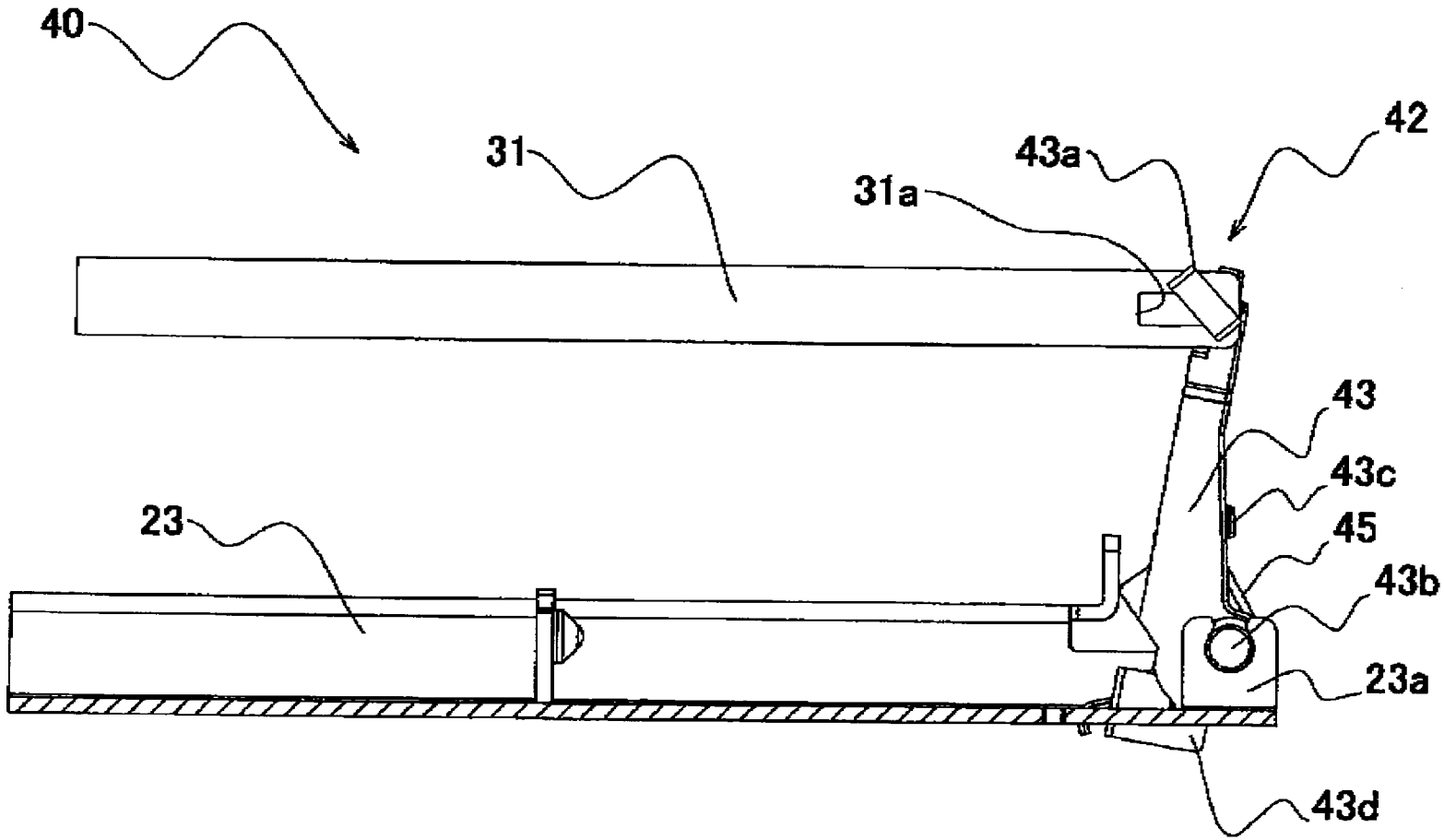
FIG. 5 is an enlarged rear view of the left-side end of the encoder support portion.

Next, the linear scale support device will be explained in detail by reference to FIGS. 3, 4A, 4B and 5. FIG. 4A is an enlarged top view of left-hand end portion of the second guide member 23, and FIG. 4B is an enlarged front view of the left-hand end portion of the second guide member 23. FIG. 5 is an enlarged back view of the left-hand end portion of the second guide member 23.

In the MFD 1 of the present embodiment, there is provided a linear scale support portion 40 which functions as the linear scale support device, which supports the linear scale 30 and which includes the second guide member 23 as a main body thereof. The linear scale support portion 40 has a first support section 41 supporting the right-hand end portion of the linear scale 31 and a second support section 42 supporting the left-hand end portion of the same 31.

The second guide member 23 has a channel-like configuration formed by punching and bending a metal plate so as to have front and back side walls, a base portion, and an upper opening. In the left-hand end portion of the second guide member 23, the base portion is cut, and bent vertically upwards, so as to form a pair of shaft support portions 23*a*, 23*a* which face each other in the backward and frontward directions. The two shaft support portions 23*a*, 23*a* have respective U-shaped cutouts. Also, in the left-hand end portion of the base portion of the second guide member 23, there is provided a guide recess 23*c* which is formed between the two shaft support portions 23*a*, 23*a* so as to extend in the main scanning direction. Further, in a vicinity of front one of the two shaft support portions 23*a*, 23*a* formed in the base portion of the second guide member 23, there is formed a through-hole 23*d* for holding one end of a helical torsion spring 45 such that said one end of the helical torsion spring 45 is inserted into the through-hole 23*d*. The helical torsion spring 45 will be described later.

The first support section 41 comprises a first support member 41*a* which is an elongate metal plate, which is arranged to extend in the upward and downward directions and which is fixed in a right-hand end portion of the second guide member 23. On a back surface of an upper end portion of the first support member 41*a*, there is formed a first projection 41*b* to which one end of the linear scale 31 is removably attached. In the opposite end portions of the linear scale 31 in the rightward and leftward directions, there are formed respective rectangular through-holes 31*a*, 31*a* (shown in FIG. 4B and FIG. 5, etc.) each of which is elongate along the longitudinal direction of the linear scale 31. In the meantime, the first projection 41*b* is formed such that the distal end portion thereof extends in a direction away from the second support section 42, i.e., in the rightward direction, so as to be L-shaped in its top view. The first projection 41*b* is inserted in the through-hole 31*a* formed in one end of the linear scale 31 so as to hold the one end of the linear scale 31, limit a movement of the linear scale 31 toward the other end thereof (i.e., the second support section 42) and prevent the linear scale 31 from falling off.

Meanwhile, the second support section 42 comprises a second support member 43 which is formed by injection-molding of a synthetic resin material and the helical torsion spring 45 which biases the second support member 43 toward outward, namely, toward the left direction in which the linear scale 31 is stretched.

The second support member 43 is substantially rigid and has an elongate shape. Also the second support member 43 is arranged in a standing posture in the left-hand end portion of the second guide member 23. The second support member 43 has, on a back surface of an upper end portion thereof, a second projection 43*a* as an engagement projection which is inserted in, and engaged with, the through-hole 31*a* formed in the other end of the linear scale 31. The second projection 43*a* functions as a holding portion which holds the other end of the linear scale 31 removably The second projection 43*a* has a T-shaped cross-section in which a distal end portion and a stem portion are integrally formed. More specifically, the distal end portion has a rectangular flat shape which is substantially the same as the shape of the through-hole 31*a*, and the stem portion supports the distal end portion. The distal end portion is formed so as to be perpendicular to the stem portion, namely, to be perpendicular to a direction in which the second projection 43*a* projects. The longitudinal direction of the distal end portion is inclined in some degree with respect to the upward and downward directions when the second support member 43 takes a standing posture.

On opposite lateral surfaces of the second support member 43 in the backward and forward directions in a vicinity of a lower end portion of the same 43, there are formed two cylindrical shafts 43*b*, 43*b* for supporting the same 43 to be pivotable. Each of the two shafts 43*b*, 43*b* has a centerline (i.e., a pivot axis) which is perpendicular to the main scanning direction. Both pivot axes coincide with each other. Further, on a lengthwise middle portion of a front surface of the second support member 43, there is formed a spring hook 43*c* which is L-shaped and protrudes from the same 43.

In addition, in a side of the lower end portion of the second support member 43 (i.e., a right-hand side of the same 43) facing the first support member 41*a*, there is provided a guided portion 43*d* which is a flat-shaped protrusion and which has substantially the same thickness as a width of the guide recess 23*c* formed on the second guide member 23 so as to slide in the guide recess 23*c*.

In the meantime, the helical torsion spring 45 as an elastic member is attached to the second support member 43 such that one of the two shafts 43*b*, 43*b* that is formed on front one of the two lateral surfaces of the second support member 43 extends through the spring 45. The helical torsion spring 45 is disposed at a position where the centerline of the same 45 coincides with the pivot axis of the front shaft 43*b*. One end of the helical torsion spring 45 is supported by the spring hook 43*c* formed on the second support member 43, and the other end of the spring 45 is inserted in the through-hole 23*d* formed in the base portion of the second guide member 23. The pivot axis is nearer to the spring hook 43*c* than to the second projection 43*a*, whereby the second support member 43 is biased, at a position which is nearer to the pivot axis than the second projection 43*a*, by the helical torsion spring 45.

The two shafts 43*b*, 43*b* are inserted into the respective cutouts formed in the two shaft support portions 23*a*, 23*a* of the second guide member 23 through respective top openings of the same 23*a*, 23*a*, whereby the second support member 43 is supported pivotably by the second guide member 23. The second support member 43 is pivotable about the pivot axis defined by the two shafts 43*b*, 43*b* relative to the second guide member 23, whereby the second projection 43*a* moves along a predetermined path.

In the second support section 42, the guided portion 43*d* fits in the guide recess 23*c* such that opposite surfaces of the guided portion 43*d* in an axial direction (i.e., the backward and forward directions) are held in contact with opposed surfaces of the second guide member 23 that define the guide recess 23*c*, whereby the movement of the second support member 43 in the axial direction is limited. Also a portion of the second support member 43 that is located below the shafts 43*b*, 43*b* contacts a left-hand edge of the second guide member 23 when an upper portion of the second support member 43 is inclined to a certain extent in the leftward direction, thereby limiting the inclining movement of the second support member 43 in a direction in which the upper portion of the second support member 43 moves away from the first support section 41. That is, the second support section 42 has an axial-direction-movement limiting mechanism. In brief, the guided portion 43*d* of the second support member 43 and the guide recess 23*c* of the second guide member 23 constitute the axial-direction-movement limiting mechanism. The guide recess 23*c* functions as a guide portion of the axial-direction-movement limiting mechanism.

There will be described a method of attaching the linear scale 31, by reference to FIG. 3 and FIGS. 6A-6D. Firstly, the first projection 41*b* formed on the first support member 41*a* is inserted into the through-hole 31*a* formed in one end (i.e., right-hand end) of the linear scale 31. Consequently, the right-hand end of the linear scale 31 is supported by the first support section 41, and the movement of the linear scale 31 toward the second support member 43 is limited.

Figure 6A:
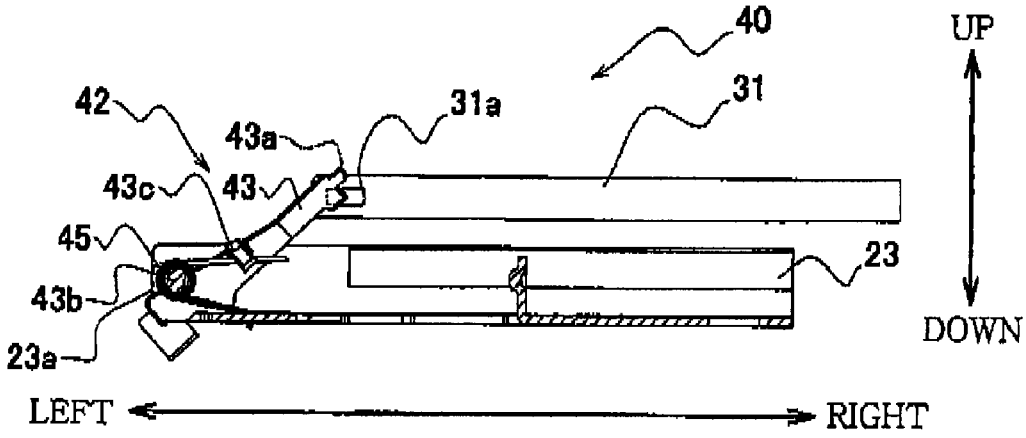
FIGS. 6A, 6B, 6C and 6D are illustrative views for explaining steps of method of assembling a linear scale with the encoder support portion, each as a cross-sectional view taken along a line A-A of FIG. 4A.
Figure 6B:
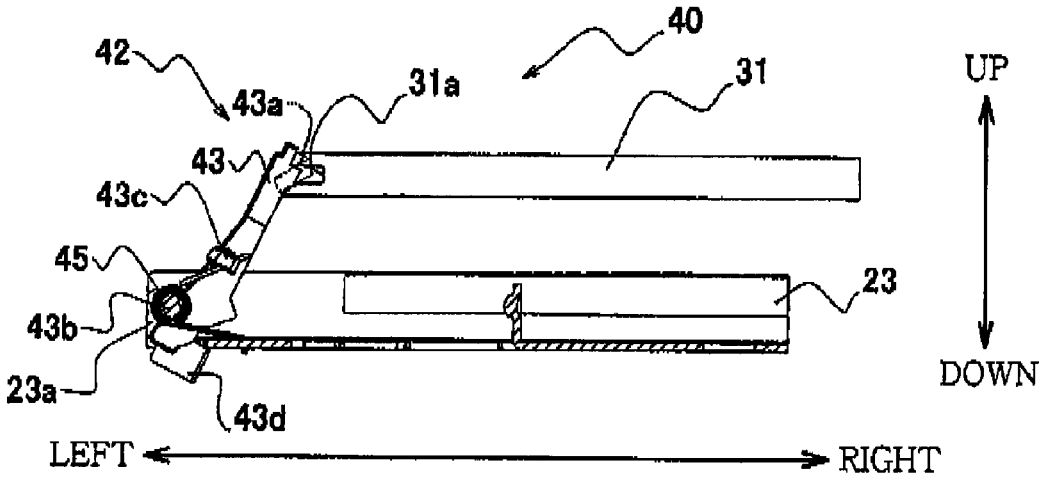
Figure 6C:
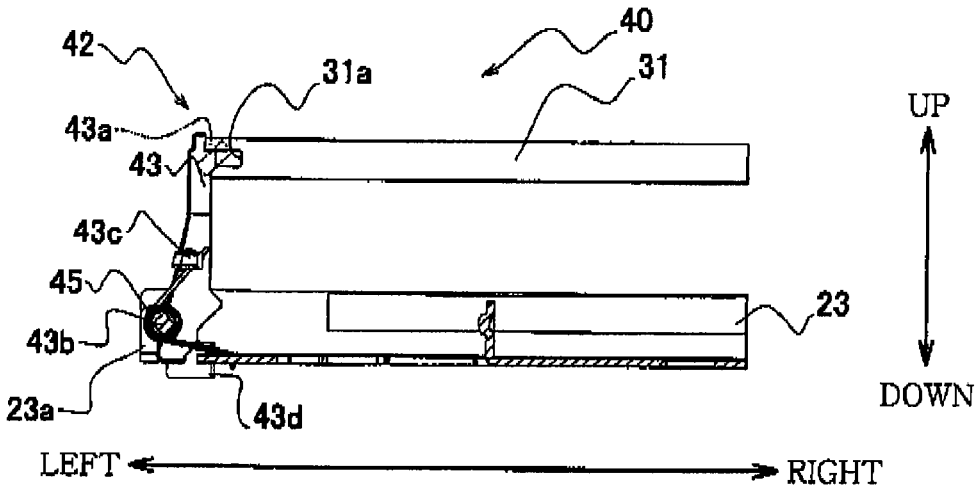
Figure 6D:
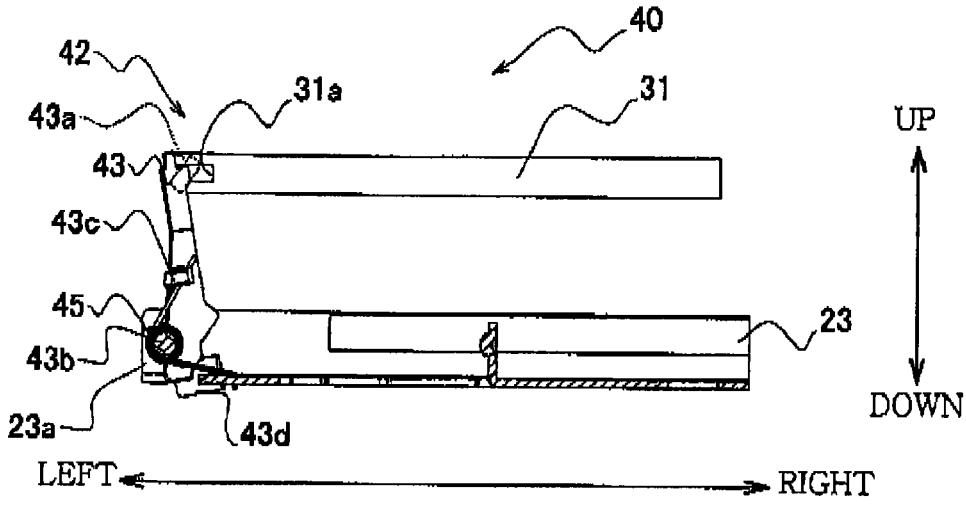

Secondly, as shown in FIG. 6A, the second projection 43*a* is inserted into the through-hole 31*a* formed in the other end (i.e., left-hand end) of the linear scale 31 while the second support member 43 is inclined in an inward direction (i.e., the rightward direction) such that the thorough hole 31*a* formed in the left-hand end of the linear scale 31 corresponds to the distal end portion of the second projection 43*a*. In brief, the second projection 43*a* is inserted into the through-hole 31*a* such that the respective longitudinal directions of the rectangular flat-shaped distal end portion and the rectangular through-hole 31*a* coincide with each other.

In the above-described state, the helical torsion spring 45 is elastically deformed by a force to incline the second support member 43 in a direction opposite to the direction in which the spring 45 biases the second support member 43. When the force in the inclining direction (i.e., a pushing force by an operator) is released, the second support member 43 pivotally moves from an inclined position (shown in FIG. 6A) to a support position in which the same 43 supports the linear scale 31 in a tensioned state (shown in FIG. 6D). In brief, the helical torsion spring 45 biases the second support member 43 in a direction in which the distal end portion of the second projection 43*a* moves away from the first support section 41. As shown in FIG. 3, the opposite ends of the linear scale 31 are supported by the first support section 41 and the second support section 42, respectively, whereby the linear scale 31 is set up in the tensioned state in the main scanning direction. Under the above-described tensioned state, the longitudinal direction of the distal end portion of the second projection 43*a* and the longitudinal direction of the through-hole 31*a* intersect at a point, namely, the second projection 43*a* is not aligned with the through-hole 31*a*, so as to prevent the linear scale 31 from falling off the second support member 43 (shown in FIG. 5). In this state, the second support member 43 is movable to change the posture thereof. Further described, as described above, the distal end portion does not pass through the through-hole 31*a* when the second support member 43 is in a posture in which the second support member 43 gives tension to the linear scale 31, and passes through the through-hole 31*a* when the second support member 43 is in a specific posture in which the second support member does not give tension to the linear scale 31.

To detach the linear scale 31 from the support members 41*a*, 43 (i.e., the first support member 41*a* and the second support member 43) for, e.g., maintenance of the MFD 1, the above-described attaching method is practiced in the reverse order.

As described above, in the MFD 1 of the present embodiment, the helical torsion spring 45 (i.e., the elastic member) biases the resin-made second support member 43 which is substantially rigid and which is pivotally movable. According to the arrangement, a stress produced in the elastic member by the movement of one end portion of the linear scale 31 is lowered. In other words, in the present embodiment, an amount of deformation of the elastic member is lowered or minimized. Accordingly, the plastic deformation of the elastic member can be prevented.

In the present MFD 1, when a load is added to the linear scale 31 by being touched by an operator's hand at maintenance, assembly work or the like, the second support member 43 is pivoted or inclined so as to shorten a distance between the two positions where the opposite ends of the linear scale 31 are supported. Therefore, breaking of the linear scale 31 can be prevented.

In the present MFD 1, the helical torsion spring 45 can be disposed in a comparatively reduced space because the helical torsion spring 46 is provided around one of to the shafts 43*b* formed on the second support member 43. Moreover, a spring constant of the helical torsion spring 45 can easily be determined by adjusting its curvature, winding number and so on, whereby the helical torsion spring 45 can give an appropriate tension to the linear scale 31.

In the present MFD 1, the movement of the second support member 43 in the axial direction of the shafts 43*b* is prevented because the guided portion 43*d* of the second support member 43 is fit in the guide recess 23*c*. Consequently, rattling of the second support member 43 in the axial direction of the shafts 43*b* is also prevented. Therefore, the position where the linear scale 31 is supported can be stabilized, whereby deteriorating of detection accuracy of position of the carriage 5 can be prevented. Moreover, the position of the second support member 43 can be prevented from being shifted in the axial direction of the shafts 43*b* in the present MFD 1. The shifting of position of the second support member 43 may cause interference between the linear scale 31 and detector 32 (i.e., interference between the linear scale 31 and the carriage 5). Accordingly, the linear scale 31 can be prevented from being damaged by the interference with the detector 32.

In the present MFD 1, the second projection 43*a* can be inserted into, and be taken off through, the through-hole 31*a* of the linear scale 31 only when the second support member 43 is inclined such that the direction of extent of the thorough hole 31*a* of the linear scale 31 coincides with the direction of extent of the distal end portion of the second projection 43*a*. Consequently, it is possible to prevent the linear scale 31 from falling off the second support member 43 even if the second support member 43 is forcedly inclined by an operator's touching of the linear scale 31 at maintenance, an assembly work or the like.

In addition, as compared with a structure in which a plate spring directly supports one end of a linear scale, a developed area of the second guide member 23 can be reduced in the present MFD 1. In the structure in which the plate spring directly supports one end of the linear scale, it is necessary to employ a second guide member 23 having a side wall to fix the plate spring. As a result, the developed area of the second guide member 23 is increased in the structure in which the plate spring directly supports one end of the linear scale. In contrast, in the MFD 1 of the present embodiment, the side wall can be omitted or downsized in the second guide member 23 since the second support member 43 is pivotably supported. Therefore, a material cost of the second guide member 23 (i.e., a production cost of the present MFD 1) can be reduced.

In the structure in which the plate spring directly supports one end of the linear scale, the plate spring costs high because the plate spring is made of a relatively expensive material and needs to be processed into a complex shape. In contrast, in the MFD 1 of the present embodiment, the helical torsion spring 45 adopted as the elastic member is not needed to be processed into a complex shape, whereby the MFD 1 can be produced at a very low cost on the whole.

One of numerous embodiments of the present invention is illustrated herein before. It is to be understood that the present invention can be embodied with various changes and modifications without departing from the spirit and scope of the invention defied in the appended claims. For instance, the shape of each of the through-hole 31*a* of tie linear scale 31 and the distal end portion of the second projection 43*a* of the second support member 43 is not limited to a rectangle. More specifically, it is possible for each of the through-hole 31*a* and the distal end portion of the second projection 43*a* to adopt various elongate shapes such as an elliptic shape or asymmetric with respect to a vertical direction or a horizontal direction.

Further, the elastic member biasing the second support member 43 is not limited to the helical torsion spring 45. A plate spring, a coil spring or a rubber may be adopted as the elastic member as well.

Furthermore, the support sections 41, 42 including the support members 41*a*, 43 which support the opposite ends of the linear scale 31 are not needed to extend in a vertical direction, but tie support members 41*a* , 43 may be arranged to extend in a horizontal direction (i.e., the backward and forward directions). It is also possible to arrange the support sections 41, 42 which support the opposite ends of the linear scale 31, respectively, such that each of the respective support members of the support sections 41, 42 is capable of being inclined.

What is claimed is:

1. An image recording apparatus comprising:

a linear encoder which includes a linear scale having a plurality of detectable portions angled at a predetermined pitch and a detector which detects the plurality of detectable portions while being moved along the linear scale; and a linear scale support device having a pair of support sections which support opposite ends of the linear scale, respectively, so as to set up the linear scale in a tensioned state in a main scanning direction, one of the pair of support sections including (a) a support member which is substantially rigid, which has a holding portion that holds one of the opposite ends of the linear scale and which is movable such that the holding portion moves along a predetermined path, and (b) an elastic member which biases the support member in a direction in which the holding portion moves away from the other of the opposite ends of the linear scale.

2. The image recording apparatus according to claim 1, wherein the support member is movable between a support position in which the support member is possible to give tension to the linear scale and an inclined position in which the support member is inclined from the support position.

3. The image recording apparatus according to claim 1, wherein the support member is pivotable about a pivot axis which is perpendicular to the main scanning direction.

4. The image recording apparatus according to claim 3, wherein the linear scale support device has a main body, and wherein the support member is supported pivotably with respect to the main body of the linear scale support device.

5. The image recording apparatus according to claim 4, wherein said one of the pair of support sections has a shaft which defines the pivot axis and which enables the support member to be supported pivotably with respect to the main body of the linear scale support device.

6. The image recording apparatus according to claim 3, wherein the elastic member biases the support member at a portion thereof which is nearer to the pivot axis than the holding portion.

7. The image recording apparatus according to claim 3, wherein the elastic member is a helical torsion spring.

8. The image recording apparatus according to claim 7, wherein the helical torsion spring is disposed at a position where a centerline of the helical torsion spring coincides with the pivot axis.

9. The image recording apparatus according to claim 8, wherein the linear scale support device has a main body, and wherein the support member is supported pivotably with respect to the main body of the linear scale support device, wherein said one of the pair of support sections has a shaft which defines the pivot axis and which enables the support member to be supported pivotably with respect to the main body of the linear scale support device, and wherein the helical torsion spring is disposed such that the shaft extends therethrough.

10. The image recording apparatus according to claim 3, wherein said one of the pair of support sections includes an axial-direction-movement limiting mechanism which limits the support member from moving in an axial direction in which the pivot axis extends.

11. The image recording apparatus according to claim 10, wherein the linear scale support device has a main body, and wherein the support member is supported pivotably with respect to the main body of the linear scale support device, and wherein the axial-direction-movement limiting mechanism includes a guide portion which is provided by a portion of the main body of the linear scale support device and which guides at least a portion of the support member such that the support member does not move in the axial direction.

12. The image recording apparatus according to claim 1, wherein said one end of the linear scale has a through-hole which has a prescribed shape and the holding portion has an engagement projection which is inserted in, and engaged with, the through-hole for holding said one end of the linear scale.

13. The image recording apparatus according to claim 12, wherein the support member is movable so as to change a posture thereof and the engagement projection has a distal end portion which is formed so as not to pass through the through-hole when the support member is in a posture in which the support member gives tension to the linear scale, and so as to pass through the through-hole when the support member is in a specific posture in which the support member does not give tension to the linear scale.

14. The image recording apparatus according to claim 13, wherein a cross-sectional shape of the distal end portion of the engagement projection, taken along a plane perpendicular to a direction in which the engagement projection extends, is substantially same as a shape of the through-hole.

15. The image recording apparatus according to claim 13, wherein the engagement projection has such a shape that the movement of the support member is permitted in a state in which the engagement projection is inserted in the through-hole.

16. The image recording apparatus according to claim 12, wherein the support member is pivotable about a pivot axis which is perpendicular to the main scanning direction and the engagement projection extends parallel to an axial direction in which the pivot axis extends.

17. The image recording apparatus according to claim 1, wherein the image recording apparatus further comprises a recording head and a head-moving device which moves the recording head in the main scanning direction, and wherein the detector is provided so as not to move relative to the recording head.

18. The image recording apparatus according to claim 17, wherein the linear encoder is used for detecting a position of the recording head in the main scanning direction.

19. The image recording apparatus according to claim 17, wherein the recording head comprises an ink-jet head which ejects ink droplets onto a recording medium.

* * * * *